United States Patent [19]

Schoeman

[11] 4,052,488

[45] Oct. 4, 1977

[54] SUPPLYING FUEL TO INTERNAL COMBUSTION ENGINES

[76] Inventor: Marthinus Johannes Schoeman, 13-14th Ave., Edenvale, Transvaal Province, South Africa

[21] Appl. No.: 604,002

[22] Filed: Aug. 12, 1975

[30] Foreign Application Priority Data

Sept. 12, 1974 South Africa ..... 74/5824

[51] Int. Cl.[2] ..... F02M 7/22

[52] U.S. Cl. ..... 261/18 A; 261/50 A; 261/51; 261/64 C; 261/67; 251/209

[58] Field of Search ..... 261/18 A, 50 A, 67, 261/51, 64 B, 64 C; 251/209

[56] References Cited

U.S. PATENT DOCUMENTS

| | | | |
|---|---|---|---|
| 1,235,180 | 7/1917 | Barber et al. | 261/64 C |
| 1,285,609 | 11/1918 | Bubb | 261/64 C |
| 1,286,856 | 12/1918 | Weiland | 261/44 A |
| 1,330,265 | 2/1920 | Hinton | 261/64 C |
| 1,337,326 | 4/1920 | Rice | 261/64 C |
| 1,369,419 | 2/1921 | Gibford | 261/67 |
| 1,383,044 | 6/1921 | Weiland | 261/64 C |
| 1,563,705 | 12/1925 | Ellehammer | 261/51 |
| 1,773,289 | 8/1930 | Waite | 261/50 A |
| 1,828,902 | 10/1931 | Monosmith et al. | 261/50 A |
| 2,246,408 | 6/1941 | Hammond | 261/50 R |
| 2,583,406 | 1/1952 | Arnold | 261/50 A |
| 2,595,720 | 5/1952 | Snyder | 261/50 A |
| 2,642,852 | 6/1953 | Bester | 261/18 A |
| 3,322,408 | 5/1967 | Stoltman | 261/50 A |
| 3,432,152 | 3/1969 | Sweeney | 261/50 A |
| 3,484,220 | 12/1969 | Jones | 261/64 C |

*Primary Examiner*—Tim R. Miles

*Attorney, Agent, or Firm*—Stevens, Davis, Miller & Mosher

[57] ABSTRACT

A carburettor for an internal combustion engine, which includes a duct connectable to a combustible charge inlet of the engine and having opposed internal wall portions which are parallel, a regulatable fuel inlet for feeding fuel into the duct, and a vacuum inducing vane within the duct and upstream of the fuel inlet, the vacuum inducing vane being biased towards a closed position to impede airflow through the duct and being displaceable against the bias by airflow through the duct, thereby, during operation, to create a negative pressure downstream of the vacuum inducing vane.

13 Claims, 6 Drawing Figures

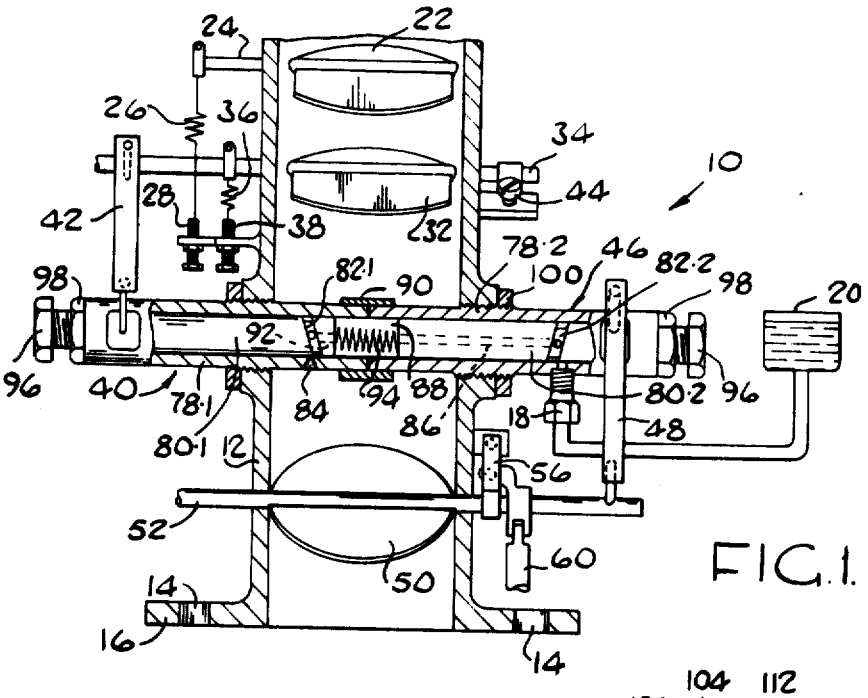
FIG. 1.
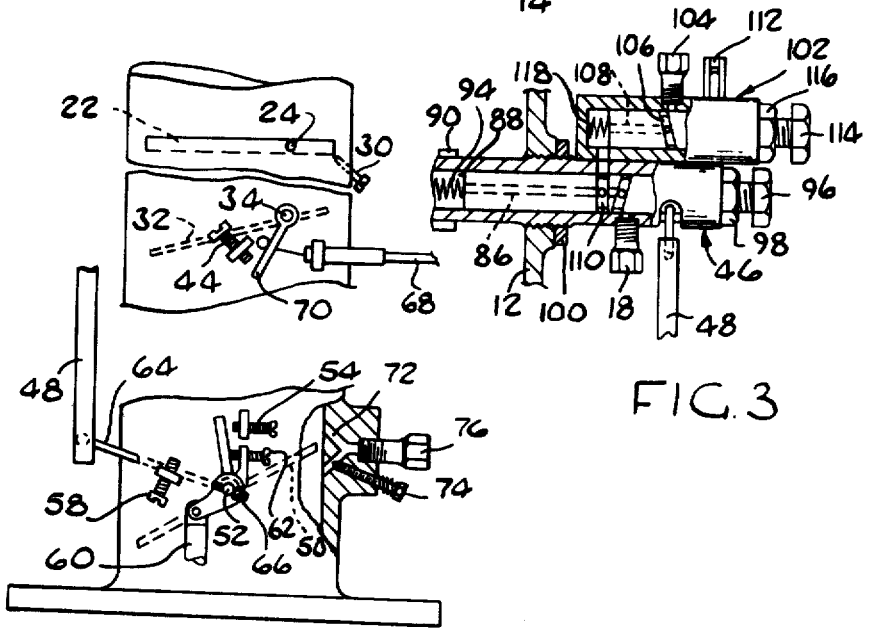
FIG. 3
FIG. 2.

SUPPLYING FUEL TO INTERNAL COMBUSTION ENGINES

This invention relates to supplying fuel to internal combustion engines.

Many prior carburettors of which the applicant is aware suffer from the disadvantages that they are complex and costly to produce and do not permit of ready adjustment. Passages and channels for feeding fuel through the various stages of the prior carburettors necessitate costly machining and casting operations during manufacture. It is an object of this invention to provide a carburettor which, it is believed, will avoid these disadvantages.

According to the invention there is provided a carburettor for an internal combustion engine, which includes a duct connectable to a combustible charge inlet of the engine and having parallel internal side walls, a regulatable fuel inlet for feeding fuel into the duct, and a vacuum inducing vane within the duct and upstream of the fuel inlet, the vacuum inducing vane being biassed towards a closed position to impede airflow through the duct and being displaceable against the bias by airflow through the duct, thereby, during operation, to create a negative pressure downstream of the vacuum inducing vane.

The closed position of the vacuum inducing vane may be determined by an adjustable stop formation. The bias applied to the vacuum inducing vane may also be adjustable.

the regulatable fuel inlet may include a regulating valve having a fuel outlet within the duct, the regulating valve being controllable in response to movement of a fuel control vane mounted to be displaceable by airflow through the duct. The fuel control vane and vacuum inducing vane may be pivotally mounted offset from the axis of the duct. They may also be pivotable in opposite directions relative to each other.

In addition to being controllable in response to movement of the fuel control vane, the regulating valve may also be manually displaceable, e.g. via a cable, towards its open position. This permits extra fuel to be supplied into the duct while the engine is being started or when extra fuel is needed under load or power conditions.

The regulating valve may be controllable by the fuel control vane via an adjustable linkage.

In another embodiment, the regulating valve may be controllable by the fuel control vane via a cam and cam follower arrangement, the cam having an irregular profile to permit a non-linear inter-relationship between displacement of the fuel control vane and the opening and closing of the regulating valve.

The fuel control vane may be biassed towards an inoperative position thereby to bias the regulating valve towards its closed position, the bias applied being adjustable. The closed position of the regulating valve may be determined by an adjustable stop formation. The stop formation is conveniently set so as to cause cutting off of the outlet of the regulating valve completely when the engine is at a standstill.

The carburettor may also include at least one control valve in series with the regulating valve and adapted to control the supply of fuel from a fuel source into the regulating valve. The control valve may be operable in conjunction with a butterfly valve in the duct, the butterfly valve in turn being operable by a throttle linkage. The control valve may be operable in conjunction with the butterfly valve via an adjustable linkage.

The control and regulating valves may be located transversely to the axis of the duct in opposed end to end relationship, the outlet from the regulating valve being located, in operation, within a concentrated airstream resulting from airflow deflected by the vacuum inducing vane.

The regulating valve and/or the control valve may be in the form of a housing having an inlet and an outlet, with a regulating member in sealing engagement with the inner walls of the housing, the regulating member having a groove formed in its periphery to form a restricted passage between the inlet and the outlet, and the regulating member being controllably displaceable to vary the supply of fuel from the inlet through the restricted passage to the outlet.

The groove in the regulating member may extend helically around the regulating member and, during rotation of the regulating member, may be brought progressively into full alignment with the inlet or with the outlet. In another embodiment, the groove in the regulating member may be tapered and extend around the periphery of the regulating member in alignment with the inlet or with the outlet, the regulating member being rotatably displaceable to permit variation of the volume of fuel capable of being supplied through the groove.

The regulating member may also be axially displaceable relative to the inlet or to the outlet to permit adjustment of the initial alignment of the groove with the inlet or with the outlet. The regulating member may be axially displaceable by means of a working fluid, to permit the groove to be brought into slight misalignment with the inlet or with the outlet. The working fluid may be obtained by means of a negative pressure obtained from within the duct when the engine is running against compression to economise on the amount of fuel passed into the engine.

When the carburettor is used for supplying a plurality of fuels or a mixture of a fuel and an additive to the engine, it may include a plurality of control valves arranged in parallel each having a regulatable restricted passage. The taper or the cross section of the respective grooves forming the restricted passages may be different to permit proportioning of different types of fuel fed into the respective inlets. If desired or necessary, when, say, oil is used, it may be supplied under pressure to the one inlet.

When the fuel used is a gas, gas under a predetermined pressure may be fed into the duct via the regulating valve. When the fuel used is petrol, petrol may be fed under gravity or under a predetermined pressure into the duct.

An embodiment of the invention will now be described by way of example with reference to the accompanying drawings, in which:

FIG. 1 shows an axial section of a carburettor in accordance with the invention;

FIG. 2 shows a side elevation of portion of the carburettor shown in FIG. 1;

FIG. 3 shows a sectional view of portion of a modified form of the carburettor shown in FIG. 1;

Figure 5:
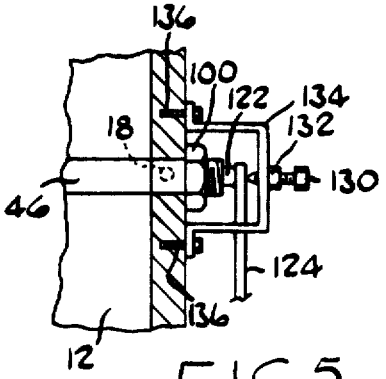
Figure 6:
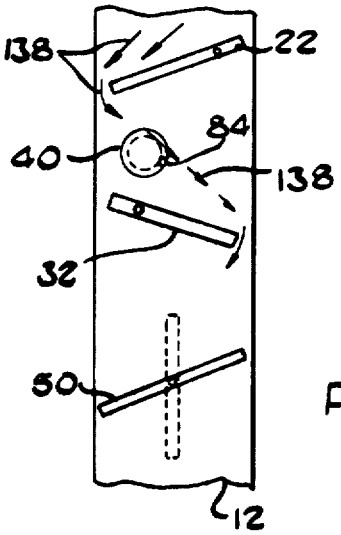

FIG. 5 shows a schematic sectional view of portion of the carburettor showing in particular a further means of controlling the axial position of the regulating member of the control or regulating valve; and FIG. 6 shows a schematic side elevation of a modification of the carburettor showing a particular arrangement and location of the vacuum inducing vane, regulatable fuel inlet, fuel control vane and butterfly valve.

Referring to the FIGS. 1 to 3, reference numberal 10 generally indicates a carburettor for an internal combustion engine. The carburettor includes a duct in the form of a barrel 12 opposed internal wall portion which are parallel. The duct is connectable to the combustible charge inlet of the engine, e.g. to the inlet manifold, via bolts or studs passing through apertures 14 in a flange 16.

A fuel inlet 18 is provided for feeding fuel into the barrel 12 from a chamber schematically illustrated at 20. The camber 20 could be formed integrally with the barrel 12 or could be merely attached thereto or be mounted separately therefrom. The chamber 20 may supply fuel under gravity to the inlet 18 and may be controlled by a float controlled valve (not shown). If the fuel used is a gas, a pressure regulator may be provided intermediate the gas source and the inlet 18.

A vacuum inducing vane 22 is provided at the upper end of the barrel 12 upstream of a regulatable fuel inlet. The vane 22 is mounted on an offset spindle 24 to impede airflow through the barrel 12 and is biased to the closed position by means of a spring 26. The tension of the spring 26 is adjustable by means of a screw 28 to create the desired negative pressure.

As shown in FIG. 2, the closed position of the vacuum inducing vane 22 is determined by a stop formation in the form of a screw 30 which is adjustable.

The carburettor also has a fuel control vane 32 which is displaceable by airflow through the barrel 12. The fuel control vane 32 is also mounted on an offset spindle 34 and biased to the closed position by a spring 36, the tension of which is adjustable by means of a screw 38. The initial position of the vane 32 is determined by a screw 44 which is adjustable.

The spindle 34 operates a regulating valve 40 by means of a linkage 42 to control the supply of fuel into the barrel 12. The linkage 42 has two arms which engage ball and socket fashion with the linkage, the arms being conveniently adjustable in length to permit adjustment of the stroke of the linkage. The length of the linkage 42 is conveniently also adjustable to permit adjustment of the relationship between the vane 32 and the regulating valve 40.

The regulating valve 40 is connected in series with a control valve 46 which is mounted in opposed end-to-end relationship with the regulating valve 40. The control valve 46 is operable by a linkage 48 similar to the linkage 42. The linkage 48 is operable in conjunction with a conventional butterfly valve 50 which is mounted on a centrally arranged spindle 52. The spindle 52 is operated in a conventional manner by the throttle linkage of the engine. As shown more clearly in FIG. 2, the initial position of the butterfly valve 50 is determined by a stop formation having an adjustable screw 54 in order to permit adjustment of the idling speed of the engine. The screw 54 acts against an arm 56 fixed to the spindle 52. A stop formation having an adjusting screw 58 is also provided for determining the maximum throttle opening of the butterfly valve 50.

In order to provide a fast idling speed when the engine is cold, a link 60 is pivotally mounted on the spindle 52. The link 60 operates an arm having an adjusting screw 62 to determine the fast idling speed. The link 60 is connected to a conventional temperature responsive device (not shown) which is usually mounted in proximity to or within the exhaust manifold of the engine.

As shown in FIG. 2, the linkage 48 also has a pair of arms which are connected to it ball and socket fashion. The stroke of the linkage 48 is adjustable by adjusting the position of the arm 64 relative to the spindle 52 by means of a lock nut 66.

Also as shown in FIG. 2, the vane 32 can be manually displaced by a cable 68 thereby to open the regulating valve 40 to assist in starting the engine when it is cold or to provide a richer mixture when needed e.g. under heavy load or full throttle conditions. The cable 68 engages a limb 70 mounted on the spindle 34. The limb 70 is such that the vane 32 can be displaced freely towards the open position by airflow through the barrel 12 irrespective of the position of the cable 68.

When the butterfly valve 50 is in the idling position, i.e. as illustrated in FIG. 2, air is supplied via a by-pass passage 72 provided in the walls of the barrel 12. The by-pass passage 72 has an inlet and an outlet respectively above and below the position where the upper edge of the butterfly valve 50 is in proximity to the side wall of the barrel 12. Adjustment of the airflow through the by-pass passage 72 is provided by means of an adjusting screw 74 to provide a fine adjustment of air flow under idling conditions.

a union 76 in communication with the passage 72 can be used to supply a partial vacuum to the automatic advance mechanism of the distributor of the engine.

The regulating valve 40 and the control valve 46 each comprises a tubular housing 78.1 and 78.2 in which regulating members 80.1 and 80.2 are sealingly located. The tubular housings 78.1 and 78.2 could be integral.

The regulating member 80.1 has a helical groove 82.1 which is progressively brought into alignment with an outlet aperture 84 as the regulating member 80.1 is rotated by the linkage 42.

The regulating member 80.2 also has a helical groove 82.2 capable of being brought into progressive alignment with the inlet 18 as the regulating member is rotated by the linkage 48.

Fuel from the chamber 20 is fed via the inlet 18 into the helical groove 82.2 from whence it is drawn through a passage 86 into a chamber 88 which is sealingly enclosed by a collar 90 joining the ends of the regulating valve 40 and control valve 46. The collar 90 would be omitted when the housings 78.1 and 78.2 are integral. From the chamber 88, the fuel flows into an axial passage 92 in the regulating member 80.1 and via the helical groove 82.1 to the outlet 84 and then into the barrel 12.

Each of the regulating members 80.1 and 80.2 are biased outwardly by a compression spring 94 in the chamber 88 against a pair of adjustable stop formations in the form of screws 96 having lock nuts 98. The screws 96 are used to displace the regulating members 80.1 and 80.2 axially to a minor degree to permit adjustment of the alignment of the helical grooves 82.1 and 82.2 with the outlet 84 and inlet 18 respectively. This provides a fine adjustment of the volume of fuel fed into the engine.

The housings 78.1 and 78.2 are screw threaded into the barrel 12 and held in position by lock nuts 100.

Referring now to FIG. 3, a modification to the carburettor shown in FIGS. 1 and 2 is illustrated. With this modification, a mixture of fuels or a fuel and a fuel additive can be fed into the engine. For this purpose, a further control valve 102 is mounted adjacent the control valve 46 and has an inlet 104 to which a different fuel or an additive is fed. A helical groove 106 capable of being brought into progressive alignment with the inlet 104 controls the supply of fuel which then flows via a passage 108 to an annular groove 110. The annular groove 110 is in communication with the passage 86. If desired additional control valves similar to the further control valve 102 can be mounted in parallel with the control valves 46 and 102.

With the modification shown in FIG. 3, say petrol, can be supplied to the inlet 18 and oil, or a fuel additive, can be supplied to the inlet 104. Where petrol, oil and an additive are required, three control valves would be provided. The petrol and the oil or additive are therefore supplied in parallel and a mixture thereof is fed to the regulating valve 40.

The further control valve 102 is operable by a linkage 112 similar to the linkage 42 and 48. The linkage 112 can also be linked to the spindle 52 on which the butterfly valve 40 is mounted to be operable in conjunction therewith. It will be appreciated that the amount of oil or additive added to the petrol can be varied by adjusting the stroke of the linkage 112 and or the angle of the helical groove 106. The initial position of the helical groove 106 relative to the inlet 104 is again determined by an adjusting screw 114 lockable by a lock nut 116. a spring 118 is again used to bias the control member of the valve 112 against the screw 114. Because of the viscosity of oil, it is usually necessary to supply it under pressure to the further control valve.

If gas is used as a fuel, either as a mixture with petrol, or by itself, an additional regulating valve 40 may be fitted to the barrel 12. The additional regulating valve conveniently has a larger bore than that required for petrol. The bore would extend axially as a continuation of the bore 92, to a fuel inlet similar to the inlet 18 and the gas supply would be regulated by a helical groove similar to the groove 82.2. The additional regulating valve would again be operable by the fuel control vane 32. With such an addition, gas can be used additionally or alternatively with petrol as a fuel.

Figure 4:
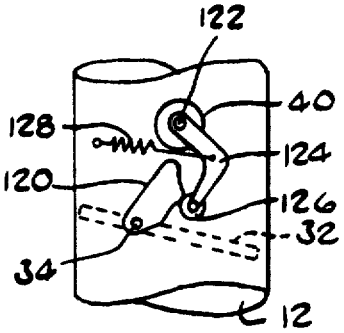
FIG. 4 shows a schematic side elevation of portion of the carburettor with a modified form of linkage between the fuel control vane and the control valve.

Referring now to FIG. 4, portion of a modified form of carburettor is shown in which the fuel control vane 32 is mounted downstream of the regulating valve 40 and not upstream as in the previous embodiments. The operation of the regulating valve 40 by the fuel control vane 32 is controlled by a cam 120 fixed to the spindle 34. The regulating member 80.1 of the regulating valve 40 has a spindle 122 protruding outwardly from the barrel 12 and the spindle 122 has an arm 124 fixed thereto. The arm 124 has a roller 126 which rides on the cam 120 and is kept against the cam by a spring 128. The bias applied by the spring 128 is conveniently adjustable. As shown, the cam 120 has an irregular profile so that a non-linear inter-relationship is obtained between displacement of the fuel control vane 32 and the opening and closing of the regulating valve 40. A similar cam and cam follower arrangement may also be provided in place of the linkage 48 intermediate the butterfly valve 50 and control valve 46.

In FIG. 5, a modified arrangement for controlling the axial position of the regulating member 80.1, 80.2 of the control or regulating valves is shown. Instead of the screw 96 and lock nut 98, a screw 130 and lock nut 132 are provided on a U-shaped housing 134 which is fixed to the barrel by screws 136. The screw 130 has a pointed end which abuts against the spindle 122 of the regulating member of the control valve 46 to permit adjustment of its axial position. In the FIG. 5 embodiment also, the fuel inlet 18 enters the control valve 46 via a union screwed into an aperture in the walls of the barrel 12 and in alignment with an aperture in the housing of the control valve and in alignment with a helical groove in the regulating member of the control valve.

In FIG. 6, the vacuum inducing vane 22 is provided upstream of the control valve 40 so as to deflect the air into a concentrated stream as indicated by arrows 138. The outlet 84 of the regulating valve 40 is, as shown, inclined in the direction of the concentrated airstream and the control valve 40 is offset to one side of the duct. The fuel control vane 32 is, as shown, pivotable in an opposite direction to the vacuum inducing vane 22 so that the concentrated airstream follows an S-shaped path through the duct. The airstream is restricted as it passes the vacuum inducing vane 22, it then expands and is then restricted by the fuel control vane 32, thereby creating, in effect, a venturi action.

In use, a coarse adjustment of the fuel supply into the barrel 12 is obtained by the operation of the control valve 46 in conjunction with the butterfly valve 50. A finer regulation of the fuel is obtained by the operation of the regulating valve 40 which is operable in conjunction with the fuel control vane 32. The regulating valve 40 prevents too much fuel being supplied to the engine at low speeds or upon sharp acceleration. Only when there is sufficient airflow through the barrel 12 to displace the vane 18 will more fuel be supplied into the barrel. While the engine is at a standstill, the regulating valve 40 is closed completely by the action of the spring 36. Under heavy load conditions, or when extra power is required, the cable 68 can be operated to open the fuel control vane 32 and thereby the regulating valve 40 partially or fully, so that fuel can be regulated by the control valve 46 only.

The vacuum inducing vane 22 controls the pressure in the barrel 12. A negative pressure is created within the barrel 12 and this negative pressure will remain substantially constant irrespective of the speed of the engine, as controlled by the setting of the tension of the spring 26. The negative pressure permits fuel to be sucked from the fuel source without the need for a venturi in the barrel 12. A self regulating venturi results so that the fuel need not be supplied under pressure into the barrel 12. Conveniently the negative pressure is set with a vacuum gauge for example to about 5 or 10 p.s.i. The setting required will be dependent on the pressure of the fuel fed into the inlet 18 from the chamber 20. If the fuel pressure is high, less negative pressure is required in the barrel 12 so that the tension of the spring 26 can be lessened.

The carburettor can be used for various types of engines and fine regulation of the fuel supplied to the engine at various speeds and under various load conditions can be achieved. The carburettor can be fitted in any configuration, e.g. updraft, sidedraft, or downdraft configuration.

The applicant believes that with a carburettor in accordance with the invention, a greater fuel economy can be achieved while maintaining engine performance. Furthermore the carburettor can be readily adapted to supply different types of fuels or mixtures of fuels and additives. Because the barrel is completely cylindrical, it is easier to manufacture than if a venturi had to be formed therein. The present carburettor in addition does not require a plurality of different channels or fuel circuits for supplying fuel under different load and throttle conditions as is required in existing carburettors. In the present carburettor, idling, power or cruising conditions are catered for by the one fuel circuit operable in conjunction with the vane 32. As a fuel, petrol or gas, or a combination of petrol and gas, can be used without modifications other than adjustments of the various settings.

What is claimed is:

1. A carburettor for an internal combustion engine including a duct connectable to a combustion charge inlet of the engine and having opposed internal wall portions which are parallel, a. a vacuum inducing vane pivotally mounted about an offset pivot axis within the duct near the upstream end thereof, being biased by biasing means towards a closed position to impede airflow through the duct and being displaceable against the biasing means by airflow through the duct, thereby, during operation, to create a negative pressure downstream thereof;

b. a fuel control vane mounted to be displaceable by the airflow through the duct;

c. a control valve and a regulating valve, the valves being connected in series and being located transversely to the axis of the duct in opposed end to end relationship, the control valve being connectable to a fuel source and the regulating valve having a fuel outlet for feeding fuel into the duct, said outlet being located downstream of the vacuum inducing vane and within the concentrated airstream resulting from the airflow deflected by the vacuum inducing vane;

d. means linking the regulating valve to the fuel control vane so that the regulating valve is controllable in response to movement of the fuel control vane;

e. a butterfly valve in the duct operable by a throttle linkage and means operably connecting the butterfly valve with the control valve.

2. A carburettor as claimed in claim 1, in which the closed position of the vacuum inducing vane is determined by an adjustable stop formation.

3. A carburettor as claimed in claim 1, in which the bias applied to the vacuum inducing vane is adjustable.

4. A carburettor as claimed in claim 1, in which the regulating valve, in addition to being controllable in response to movement of the fuel control vane, is also linked to manual operating means thereby to be manually displaceable towards its open position.

5. A carburettor as claimed in claim 1, in which the regulating valve is controllable by the fuel control vane via the adjustable linkage.

6. A carburettor as claimed in claim 1, in which the regulating valve is controllable by the fuel control vane via a cam and cam follower arrangement, the cam having an irregular profile to permit a non-linear inter-relationship between displacement of the fuel control vane and the opening and closing of the regulating valve.

7. A carburettor as claimed in claim 1, in which the fuel control vane is biased towards an inoperative position thereby to bias the regulating valve towards its closed position, the bias applied being adjustable.

8. A carburettor as claimed in claim 1, in which the closed position of the regulating valve is determined by an adjustable stop formation.

9. a carburettor as claimed in claim 1, in which the control valve is operable in conjunction with the butterfly valve via an adjustable linkage.

10. A carburettor as claimed in claim 1, in which the regulating valve or the control valve is in the form of a housing having an inlet and an outlet, with a regulating member in sealing engagement with the inner walls of the housing, the regulating member having a groove formed in its periphery to form a restricted passage between the inlet and the outlet, and the regulating member being controllably displaceable to vary the supply of fuel from the inlet through the restricted passage to the outlet.

11. A carburettor as claimed in claim 10, in which the groove in the regulating member extends helically around the regulating member and, during rotation of the regulating member, is brought progressively into full alignment with the inlet or with the outlet.

12. A carburettor as claimed in claim 10, in wich the regulating member has adjustment means whereby it is also axially displaceable within the housing relative to the inlet or to the outlet to permit adjustment of the initial alignment of the groove with the inlet or with the outlet.

13. A carburettor as claimed in claim 10, for supplying a plurality of fuels or a mixture of a fuel and an additive to the engine, which includes a plurality of control valves arranged in parallel each having a regulatable restricted passage.

* * * * *